US011170623B2

(12) United States Patent
Spencer

(10) Patent No.: US 11,170,623 B2
(45) Date of Patent: Nov. 9, 2021

(54) PORTABLE HAZARD COMMUNICATOR DEVICE

(71) Applicant: Cheryl Spencer, Kingsford, MI (US)

(72) Inventor: Cheryl Spencer, Kingsford, MI (US)

( * ) Notice: Subject to any disclaimer, the term of this patent is extended or adjusted under 35 U.S.C. 154(b) by 0 days.

(21) Appl. No.: 17/035,442

(22) Filed: Sep. 28, 2020

(65) Prior Publication Data

US 2021/0125479 A1 Apr. 29, 2021

Related U.S. Application Data

(60) Provisional application No. 62/927,132, filed on Oct. 29, 2019.

(51) Int. Cl.
*G08B 21/02* (2006.01)
*G08B 7/06* (2006.01)

(52) U.S. Cl.
CPC ..... *G08B 21/02* (2013.01); *G08B 7/06* (2013.01)

(58) Field of Classification Search
CPC ..... G08B 21/02; G08B 7/06; G08B 27/00; G08B 27/005
See application file for complete search history.

(56) References Cited

U.S. PATENT DOCUMENTS 5,790,019 A * 8/1998 Edwin ..... G08B 7/06 340/506
6,329,904 B1 * 12/2001 Lamb ..... G01W 1/00 340/286.02
6,617,964 B1 * 9/2003 Lamb ..... G01W 1/00 340/286.02
7,036,950 B1 * 5/2006 Freeman ..... E05B 17/10 362/100
7,339,467 B2 * 3/2008 Lamb ..... G08B 27/006 340/286.02
7,872,573 B2 * 1/2011 Lamb ..... G08B 27/006 340/539.1
2002/0097161 A1 * 7/2002 Deeds ..... G01W 1/10 340/601
2003/0193394 A1 * 10/2003 Lamb ..... G08B 27/006 340/539.28
2004/0083035 A1 * 4/2004 Ellis ..... G01S 13/867 701/1

(Continued)

*Primary Examiner* — Hoi C Lau
(74) *Attorney, Agent, or Firm* — McLean Law LLC; Kimberly McLean, Esq.

(57) ABSTRACT

A portable hazard communicator device including a portable housing, a visual warning indicator, an audio warning indicator, a receiver, a first control unit, a second control unit and an attachment unit. The portable housing has an internal cavity for housing a plurality of light elements. The visual warning indicator is integrated within the housing for displaying a hazard message upon activation of the visual warning indicator. The audio warning indicator unit is integrated within the housing for emitting a hazard sound upon activation of the audio warning indicator. The receiver is configured to receive one or more signals from a companion device, and the one or more signals includes a power on signal. The first control unit is configured to activate and deactivate the visual warning indicator. The second control unit is configured to activate and deactivate the audio warning indicator. The attachment unit attaches the portable housing to a surface.

11 Claims, 4 Drawing Sheets

(56) References Cited

U.S. PATENT DOCUMENTS

2004/0145496 A1* 7/2004 Ellis ..... G08G 1/127 340/905
2005/0174233 A1* 8/2005 Kennedy ..... G08B 27/008 340/539.1
2005/0237183 A1* 10/2005 Lamb ..... G08B 27/006 340/539.11
2007/0132578 A1* 6/2007 Powell ..... G08B 21/088 340/539.26
2007/0241261 A1* 10/2007 Wendt ..... G16H 40/67 250/221
2008/0266121 A1* 10/2008 Ellul ..... G08B 7/066 340/584
2009/0027190 A1* 1/2009 Curt ..... H02J 13/0075 340/539.1
2009/0051510 A1* 2/2009 Follmer ..... G07C 5/0808 340/425.5
2009/0058665 A1* 3/2009 Lamb ..... G01W 1/00 340/601
2009/0102679 A1* 4/2009 Schoettle ..... G08B 7/064 340/815.4
2009/0135006 A1* 5/2009 Schoettle ..... G08B 17/00 340/540
2009/0135009 A1* 5/2009 Little ..... G06Q 10/00 340/540
2009/0174569 A1* 7/2009 Smith ..... H04L 12/2832 340/8.1
2009/0284366 A1* 11/2009 Haartsen ..... G01S 1/70 340/531
2010/0321178 A1* 12/2010 Deeds ..... G08B 25/009 340/539.1
2011/0012742 A1* 1/2011 Johnson ..... G08B 13/08 340/669
2011/0057809 A1* 3/2011 Mahoney ..... H04M 19/02 340/691.7
2011/0140868 A1* 6/2011 Hovang ..... G08B 25/008 340/12.55
2011/0140913 A1* 6/2011 Montenero ..... G08B 21/0233 340/870.07
2011/0192857 A1* 8/2011 Rothbaum ..... F16M 11/041 220/694
2012/0112903 A1* 5/2012 Kaib ..... A61B 5/7405 340/539.12
2012/0133517 A1* 5/2012 Brausteiner ..... E05B 45/06 340/626
2013/0162423 A1* 6/2013 Rowe ..... A61B 5/1115 340/501
2014/0197946 A1* 7/2014 Park ..... G08B 5/22 340/539.11
2014/0266672 A1* 9/2014 Farley ..... G08B 29/185 340/506
2015/0097663 A1* 4/2015 Sloo ..... G08B 21/18 340/501
2015/0164416 A1* 6/2015 Nothacker ..... A61B 5/4023 340/573.1
2016/0027399 A1* 1/2016 Wilde ..... H04W 12/50 345/520
2016/0093191 A1* 3/2016 Bloom ..... G08B 27/005 340/540
2016/0106174 A1* 4/2016 Chung ..... A42B 3/0433 340/539.13
2016/0125731 A1* 5/2016 McCoy ..... G08C 17/02 340/12.22
2017/0124836 A1* 5/2017 Chung ..... H04B 7/14
2018/0196471 A1* 7/2018 Soken ..... G06F 1/182
2019/0149974 A1* 5/2019 Gazdziak ..... H04W 4/90 455/404.1

* cited by examiner

PORTABLE HAZARD COMMUNICATOR DEVICE

CROSS-REFERENCE TO RELATED APPLICATIONS

This application claims the benefit of priority of U.S. Provisional Application No. 62/927,132 filed on Oct. 29, 2019, the disclosure of which is incorporated herein by reference in its entirety.

FIELD OF THE INVENTION

Embodiments described herein generally relate to hazards, and more particularly to a portable hazard communicator device.

BACKGROUND OF THE INVENTION

Most safety regulatory requirements require that a medical facility minimizes or prevents unintended exposure to radiation, lasers, chemicals, etc. Traditional methods used for warning people to stay out of regulated areas due to potentially dangerous machinery or hazardous products rely heavily on person to person communication. This can be problematic in situations where there are lots of moving parts and heavy foot traffic from employees. Particularly, today when many medical facilities use portable radiation or laser equipment which may be transported from one location to another location within the facility. Hence, an improved way of warning people of hazardous conditions and/or dangerous areas is desired.

BRIEF DESCRIPTION OF THE DRAWINGS

The various advantages of the embodiments of the present disclosure will become apparent to one skilled in the art by reading the following specification and appended claims, and by referencing the following drawings, in which:

SUMMARY OF THE INVENTION

Figure 1:
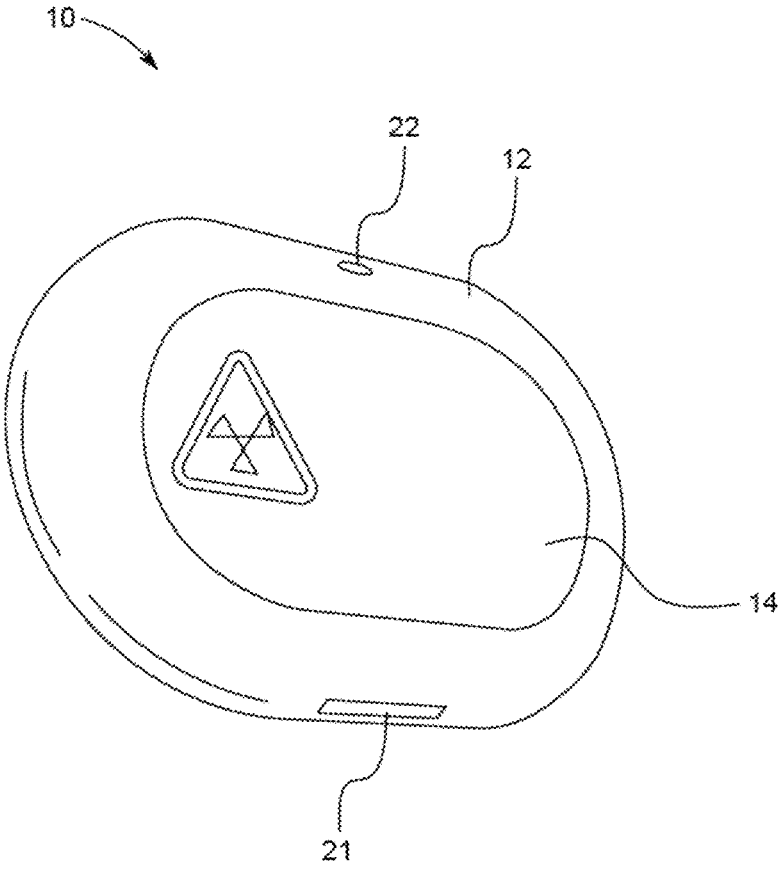
FIG. 1 shows an exemplary front view of a portable hazard communication device according to an embodiment of the present disclosure.
Figure 2:
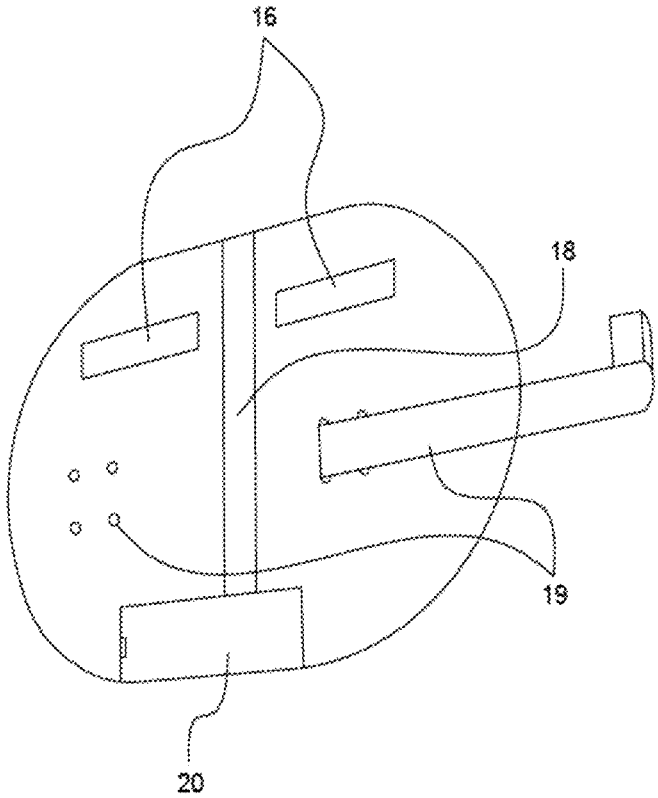
FIG. 2 shows an exemplary rear view of a portable hazard communication device according to an embodiment of the present disclosure.

The present disclosure describes a portable hazard communicator device. The portable hazard communicator device includes a portable housing having an internal cavity for housing a plurality of light elements, a visual warning indicator integrated within the housing for displaying a hazard message upon activation of the visual warning indicator, an audio warning indicator unit integrated within the housing for emitting a hazard sound upon activation of the audio warning indicator, a receiver configured to receive one or more signals from a companion device, the one or more signals including a power on signal, a first control unit configured to activate the visual warning indicator based on the received one or more signals, a second control unit configured to activate the audio warning indicator based on the received one or more signals, and an attachment unit for attaching the portable housing to a surface.

In some exemplary embodiments, the one or more signals received by the receiver includes a power on signal.

In some exemplary embodiments, the one or more signals received by the receiver includes a power off signal.

In some exemplary embodiments, the first control unit is configured to activate the visual warning indicator upon receipt of a power on signal.

In some exemplary embodiments, the second control unit is configured to activate the audio warning indicator upon receipt of a power on signal.

In some exemplary embodiments, the first control unit is configured to deactivate the visual warning indicator upon receipt of a power off signal.

In some exemplary embodiments, the second control unit is configured to deactivate the audio warning indicator upon receipt of a power off signal.

In some exemplary embodiments, the plurality of light elements are light emitting diodes (LEDs).

In some exemplary embodiments, the visual warning indicator includes a LED display.

In some exemplary embodiments, the audio warning indicator is a speaker system.

In some exemplary embodiments, the hazard message is displayed in a contrasting color from a color of the housing.

In some exemplary embodiments, the attachment unit is at least one or more from the group comprising sticky pads, a magnetic strip, and a reversible door clip.

In some exemplary embodiments, the hazard sound may include at least one or more from the group comprising a soft humming sound, a siren and a human voice stating, "do not enter the region".

DETAILED DESCRIPTION

The present disclosure relates to a portable hazard communicator device ("the device"). The device operates as an illuminated warning sign. The device is placed outside a hazardous region near the entryway to the region (e.g., the entry door), in a highly visible shoulder-height placement location, to warn on comers not to enter the region during a time when there is special equipment in use. The hazardous region may include any location where procedures are being performed that may cause harm by unintended exposure to radiation, laser, chemicals, etc., such as, for example, x-ray procedures, laser surgery procedure, or any other suitable procedure or location where a person may be exposed to dangerous conditions.

The placement of the device at the entryway region is temporary. The device is portable and able to temporarily stick and re-stick to various surfaces, such as, for example, doors, walls, wood, painted, plastic, metal or hook to a patient's curtain, at different locations where hazardous conditions are present. In fact, the device may travel with special equipment (e.g., portable x-ray or laser equipment) which is used to perform procedures which may cause hazardous environment conditions.

In one aspect, the device 10 may be used as a companion device to a piece of equipment (e.g., x-ray machine and laser machine) in a medical facility. In another aspect, the device may be used with any apparatus that can simultaneously activate a source (i.e., the source of the hazardous condition) and the device at the same time. For example, the device 10 may be used in a laboratory/research facility with dangerous elements, such as chemical and biological elements, and the device may be used in a doctor's office (e.g., laser or radiation usage) or a dentist's office (e.g., radiation usage).

As illustrated in FIGS. 1-2 and 3A-3C, the device 10 includes a sign housing 12 (i.e., portable housing), LED light lettering and sign 14 (i.e., a visual warning indicator), an attachment unit including a pair of sticky pads 16, a magnetic strip 18, and a reversible door clip 19, a battery compartment 20, a speaker system 21 (i.e., an audio warning indicator), and a receiver 22. The sign housing 12 is formed by a front face element and a back face element which collectively form the sign housing having an internal cavity therein. The internal cavity encloses a light emitting diode (LED) module including a plurality of LEDs (i.e., light elements) and power and control circuitry, which collectively form the LED light lettering and sign 14. The plurality of light elements are used to illuminate the sign housing 12 and to display a hazard message when activated. The LEDs are long lasting and may operate for approximately 50,000 hours maintenance free.

The sign housing 12 may have any suitable shape and size. In a preferred embodiment, the sign housing 12 has a rectangular shape with rounded corners and a size of approximately 160 millimeters (mm) wide, 110 millimeters (mm) high, and 39 millimeters (mm) deep. The sign housing 12 may be lightweight and may weigh less than 170 grams (g) to ensure that the device 10 is able to temporarily affix to an object or surface with various ways of adherence (i.e., attachment elements), such as, for example, sticky pads 16, magnetic strip 18 and reversible door clip 19. The sign housing 12 may be made of any suitable material. In a preferred embodiment, the sign housing is made of a durable plastic that can sustain a drop from 8 feet (ft.).

Figure 3A:
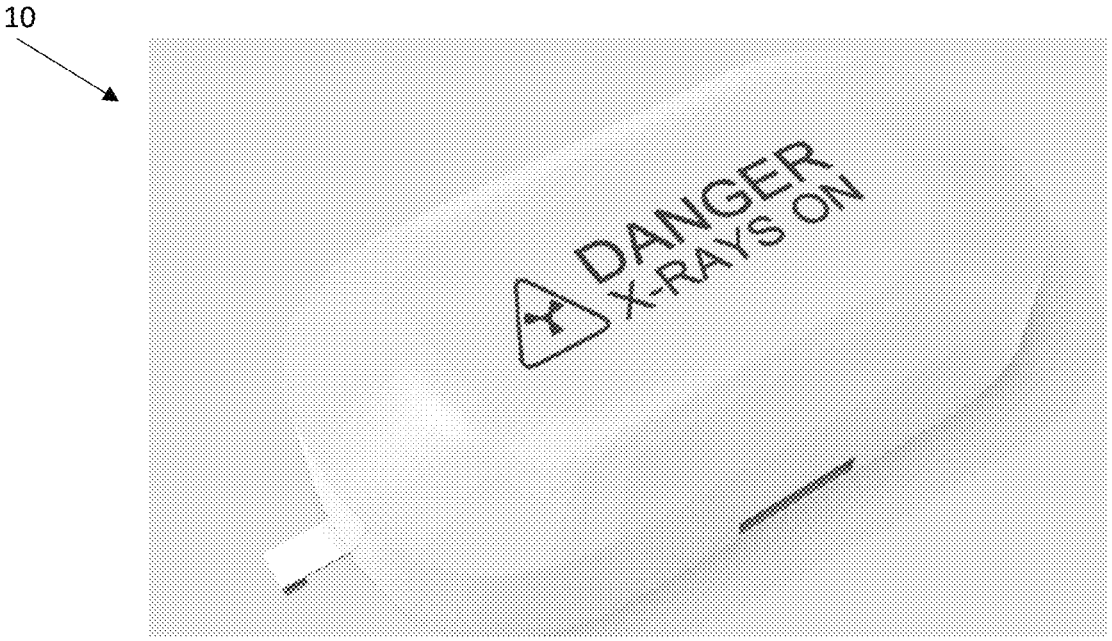
FIGS. 3A-3C show exemplary color illustrations of the portable hazard communication device.
Figure 3B:
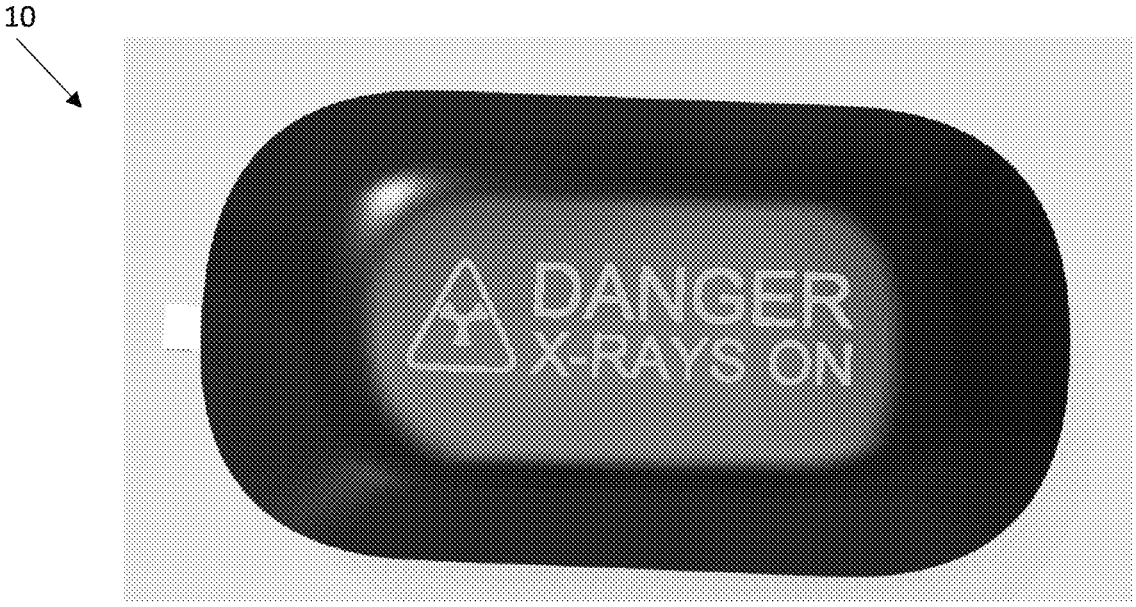
Figure 3C:
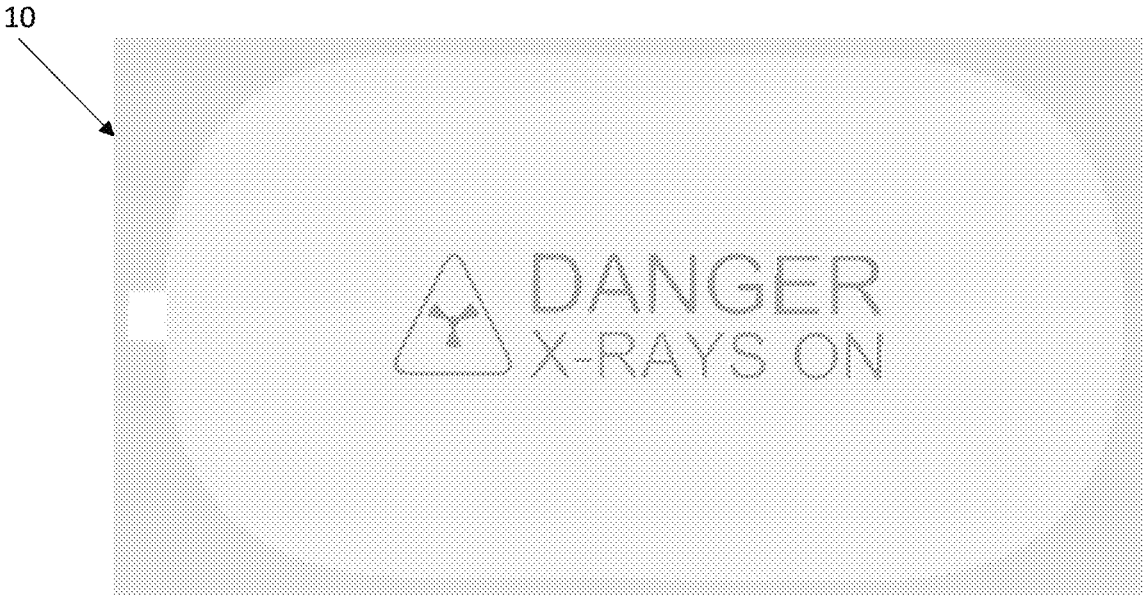

The sign housing 12 may be any color which grabs an individual's attention, such as, for example, a black background with red illuminating letters, a yellow background with blue illuminating letters, a red background with yellow illuminating lettering, as illustrated in FIGS. 3A-3C. The sign housing 12 may display a hazard message using the LED light lettering and sign 14.

The LED light lettering and sign 14 includes a LED display (i.e., LED sign) where the hazard message is displayed. The LED module includes circuitry (i.e., a first control unit) to power (i.e., activate and deactivate) the LEDs and to control the LEDs to display a hazard message based on one or more signals received from receiver 22. The LED module, and more specifically, the first control unit is configured to receive the one or more signals from receiver 22 and is configured to activate and deactivate the LEDs based on the one or more received signals from receiver 22.

The displayed hazard message may include any suitable messages, such as, for example, messages to alert an individual when it is not safe to enter a region and to alert an individual when it is safe to enter a region. The message may state, for example, "DANGER X-RAY ON" (as illustrated in FIGS. 3A-3C), "DANGER LASER ON", or "NO HAZARD LASEROFF". The messages may be generated by any suitable means, such as, for example, digital messages or engraved letters in the sign housing.

The speaker system 21 (i.e., audio warning indicator) may include a second control unit, one or more loud speakers and a sound memory storage unit. The speaker system, and more specifically, the one or more loud speakers, upon activation, may provide an audio sound (i.e., hazard sound), which operates as an audio warning indicating that no one should enter a particular area/region. In one aspect, the hazard sound may include, for example, a soft humming sound, which operates to direct an individual's attention to the device 10 where a hazard message will be displayed. In another aspect, the hazard sound may include a siren and/or any other comparable sound. In another aspect, the hazard sound may include a human voice stating, for example, "do not enter the region". Any suitable loud speakers may be used with device 10. The sound memory storage unit is configured to store the plurality of hazard sounds. The one or more loud speakers may be activated by the second control unit based on the one or more signals received from receiver 22.

In another exemplary embodiment, the device 10 may include a switch control setting which may be manually set by a user to select a particular hazard sound when the speaker system 21 is activated. So, for example, the switch control setting may allow a user to select a hazard sound between i.) humming, ii.) siren, and iii.) human voice. To this regard, the second control unit may receive the switch control setting and control the one or more loud speakers to emit the corresponding hazard sound upon activation.

In another exemplary embodiment, the second control unit may activate the one or more loud speakers to emit a sound corresponding to a source ID received from receiver 22. The second control unit may be configured to assign a particular hazard sound to a particular type of companion device, and thus, the second control unit will direct the one or more loud speakers to emit a hazard sound corresponding to the source ID.

In another exemplary embodiment, the device 10 may include a warning indicator control setting which may be manually set by a user to trigger i.) both the visual warning indicator and the audio warning indicator, ii.) only the visual warning indicator, iii.) only the audio warning indicator. The first control unit and the second control unit may receive the warning indicator control setting. The first control unit and the second control unit may activate the corresponding LEDs and one or more loud speakers respectively, based on the warning indicator control setting and the one or more received signals from receiver 22.

The receiver 22 is configured to receive one or more digitally generated wireless signals from a companion device (i.e., a source). At least one of the one or more received signals may include a power on signal which is transmitted from the companion device when the companion device is powered on. Another one of the at least one or more received signals may include a power off signal. Moreover, at least one of the one or more received signals may include a source ID, which is an identifier assigned to the companion device. The source ID allows the first and second control units to determine the type of companion device to which the device 10 is connected.

The receiver 22 sends the received power on signal and the received power off signal to the first control unit and the second control unit for further processing. Further, the receiver 22 may send the source ID signal to the first control unit and the second control unit for further processing. Upon receipt of the power on signal, the first control unit may activate the LEDs to display a hazard message if the warning indicator control setting is set to trigger a visual warning indicator. Further, the first control unit may cause a particular hazard message to be displayed on the LED light lettering and sign 14 corresponding to the received source ID signal. Further, upon receipt of the power on signal, the second control unit may activate the one or more loud speakers to emit a hazard sound corresponding to the switch control setting if the warning indicator control setting is set to trigger an audio warning indicator.

The one or more digitally generated wireless signals may be generated by any suitable companion device (i.e., source) which is within a predetermined distance away from the device 10, such as, for example, less than or equal to thirty feet. In one aspect, the digitally generated wireless signal(s) may be generated by a special equipment companion device source, such as, for example, a x-ray machine or a laser machine.

The device 10 may include any suitable wireless technology and capability that does not interfere with any digital x-ray wireless image quality or transmission for sending and/or receiving wireless signals. The special equipment companion device may include a transmitter and a foot switch or hand switch which powers-on the corresponding piece of equipment. When the switch is moved to an on position, the transmitter may send one or more signals to device 10 which is received by receiver 22. Further, when the special equipment companion device is powered off, the switch is moved to an off position and the transmitter may send one or more signals to device 10 which is received by receiver 22.

In an exemplary embodiment, the device 10 may be configured to interface with multiple companion devices, such as, for example, x-ray machine, laser, etc. In this aspect, the messages displayed on the LED light lettering and sign 14 are digital messages which are configured to change depending on the type of companion device to which the device 10 is interfaced. So, for example, one of the one or more signals received by device 10 (via receiver 22) may include a source ID corresponding to a companion device. The source ID signal may be transmitted with the power-on signal from the companion device when the companion device is powered-on. If the source ID indicates a x-ray machine (which is a first type of companion device), the message displayed may state, "DANGER X-RAY ON". If the source ID indicates a laser (which is a different/second type of companion device), the message displayed may state, "DANGER LASER ON".

In another exemplary embodiment, the device 10 may be configured to interface with a specific type of companion device (e.g., an x-ray machine or a laser) and the LED light lettering and sign 14 may display a message engraved into the display region of the device which is illuminated when activated by the first control unit upon receipt of a power-on signal from a companion device (i.e., upon receipt of the signal transmitted and generated when the companion device is powered on).

Although, the device 10 is described as including an illuminated display hazard message alert and/or a hazard sound alert, any other forms of a warning notification alert may be used, such as, for example, different illuminating colors, strobe, light pulse, etc. In one aspect, the device 10 may include a user-selectable option for choosing a method (s) of notification from audio, different illuminating colors, strobe, light pulse and display different messages.

Moreover, the device 10 may include a backup on/off switch for manually powering the device on and off. In the event that the wireless capabilities are not working, the backup power switch may be used to power the device on and off. The device 10 includes a battery compartment 20 for storing a battery for providing power to the device. Any suitable battery may be used, such as, for example, a rechargeable battery. In a preferred embodiment, the battery is a lithium battery.

As noted above, the device 10 is portable and is able to temporarily attach to a surface using one or more attachment mechanisms including a reversible door clip 19, a pair of sticky pads 16, magnetic strip 18, depending on the object or surface to which the device is attached. Using more than one attachment mechanism to attach the device 10 to an object or surface provides increased stability of the device's attachment to the object/surface. The reversible door clip 19 may include a U-shape bracket that can hug the edge of a door and may easily attach and detach to/from the door. The reversible door clip may be made out of any suitable material, such as, for example, plastic or metal. The pair of sticky pads may include a heavy duty adhesive material for affixing to various surfaces, such as, for example, doors, walls, wood, painted, plastic, metal. The magnetic strip 18 may include a magnetic material and may attach to a metal surface.

Additionally, the device 10 may be easily cleaned with disinfectant wipes.

The disclosed embodiments are not inclusive and many other modifications and variations will be apparent to someone of ordinary skill in the art with construction skills in the related arts. Together the descriptions and accompanying illustrations seek to provide an explanation of the basic principles of the embodiment and its application. It is therefore intended that the specification and embodiments be considered as exemplary only.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A portable hazard communicator device comprising:

a portable housing having an internal cavity for housing a plurality of light elements;

a visual warning indicator integrated within the housing for displaying a hazard message upon activation of the visual warning indicator, wherein the hazard message displayed corresponds to a hazard associated with a type of companion device;

an audio warning indicator unit integrated within the housing for emitting a hazard sound upon activation of the audio warning indicator;

a receiver configured to receive one or more signals from the companion device, wherein the one or more signals include a source ID identifying the type of companion device;

a first control unit configured to activate the visual warning indicator upon receipt of a power-on signal from the companion device, in accordance with a warning indicator control setting;

a second control unit configured to activate the audio warning indicator upon receipt of a power-on signal from the companion device, in accordance with the warning indicator control setting; and an attachment unit for attaching the portable housing to a surface.

2. The device of claim 1, wherein the one or more signals received by the receiver includes a power off signal.

3. The device of claim 1, wherein the first control unit is configured to deactivate the visual warning indicator upon receipt of a power off signal.

4. The device of claim 1, wherein the second control unit is configured to deactivate the audio warning indicator upon receipt of a power off signal.

5. The device of claim 1, wherein the plurality of light elements are light emitting diodes (LEDs).

6. The device of claim 1, wherein the visual warning indicator includes a LED display.

7. The device of claim 1, wherein the audio warning indicator is a speaker system.

8. The device of claim 1, wherein the hazard message is displayed in a contrasting color from a color of the housing.

9. The device of claim 1, wherein the attachment unit is at least one or more from the group comprising sticky pads, a magnetic strip, and a reversible door clip.

10. The device of claim 1, wherein the hazard sound may include at least one or more from the group comprising a soft humming sound, a siren and a human voice stating, "do not enter the region".

11. A portable hazard communicator device comprising:

a portable housing having an internal cavity for housing a plurality of light elements;

a visual warning indicator integrated within the housing for displaying a hazard message upon activation of the visual warning indicator, the visual warning indicator including a display having the hazard message engraved therein which is illuminated when activated by the first control unit, wherein the hazard message displayed corresponds to a hazard associated with a type of companion device;

an audio warning indicator unit integrated within the housing for emitting a hazard sound upon activation of the audio warning indicator;

a receiver configured to receive one or more signals from the companion device, wherein the one or more signals include a source ID identifying the type of companion device;

a first control unit configured to activate the visual warning indicator based on the received one or more signals;

a second control unit configured to activate the audio warning indicator based on the received one or more signals; and an attachment unit for attaching the portable housing to a surface.

* * * * *